US012385727B2

(12) United States Patent
Yates

(10) Patent No.: US 12,385,727 B2
(45) Date of Patent: Aug. 12, 2025

(54) FUZZY INTERFACE LAYER FOR THERMITE AND PRIMER MADE FROM THERMITE WITH FUZZY LAYER

(71) Applicant: Spectre Primer Technologies, Inc., Palm Bay, FL (US)

(72) Inventor: Daniel Yates, Melbourne, FL (US)

(73) Assignee: Spectre Primer Technologies, Inc., Palm Bay, FL (US)

( * ) Notice: Subject to any disclaimer, the term of this patent is extended or adjusted under 35 U.S.C. 154(b) by 0 days.

(21) Appl. No.: 18/649,459

(22) Filed: Apr. 29, 2024

(65) Prior Publication Data

US 2024/0361113 A1 Oct. 31, 2024

Related U.S. Application Data

(60) Provisional application No. 63/462,995, filed on Apr. 29, 2023.

(51) Int. Cl.
*F42C 19/08* (2006.01)
*C06B 45/12* (2006.01)

(52) U.S. Cl.
CPC ..... *F42C 19/083* (2013.01); *C06B 45/12* (2013.01); *F42C 19/0803* (2013.01); *F42C 19/08* (2013.01)

(58) Field of Classification Search
CPC .... F42C 19/08; F42C 19/083; F42C 19/0803; F42C 19/0819; F42C 19/0823; F42B 3/10;

(Continued)

(56) References Cited

U.S. PATENT DOCUMENTS 2,131,352 A 9/1938 Marsh
2,239,123 A 4/1941 Stoneking
(Continued)

FOREIGN PATENT DOCUMENTS

EP 0122012 A2 10/1984
EP 328257 A2 8/1989
(Continued)

OTHER PUBLICATIONS

International Search Report for PCT/US2024/026858 dated Apr. 30, 2025.

(Continued)

*Primary Examiner* — James S Bergin
(74) *Attorney, Agent, or Firm* — Lang Patent Law LLC; William F. Lang, IV

(57) ABSTRACT

A layered thermite composite includes alternating layers of metal oxide and reducing metal deposited upon a substrate. A fuzzy interface layer between each metal oxide layer and reducing metal layer includes reducing metal, reducing metal oxide, and metal oxide at least partially intermixed therein. The fuzzy interface layer forms while moving between chambers in a multi-chamber deposition process which minimizes exposure of the reducing metal to oxygen while moving between chambers. The fuzzy interface layer is not expected to grow in thickness after deposition. The combination of the relative thinness of the fuzzy interface layer as well as the presence of reactants as well as reducing metal oxide maintains the sensitivity of the layered thermite structure to mechanical ignition if the structure is used within a primer.

13 Claims, 10 Drawing Sheets

(58) Field of Classification Search
CPC ... F42B 5/10; F42B 5/16; C06B 45/12; C06B 45/14; C06B 33/00
USPC ..... 102/204, 470
See application file for complete search history.

(56) References Cited

U.S. PATENT DOCUMENTS

| | | | |
|---|---|---|---|
| 2,652,775 | A | 9/1953 | Swanson |
| 2,995,429 | A | 8/1961 | Williams et al. |
| 2,995,431 | A | 8/1961 | Bice |
| 3,122,884 | A | 3/1964 | Grover et al. |
| 3,155,749 | A | 11/1964 | Rossen et al. |
| 3,170,402 | A | 2/1965 | Morton et al. |
| 3,382,117 | A | 5/1968 | Cook |
| 3,610,151 | A | 10/1971 | Nett |
| 3,668,872 | A | 6/1972 | Camp et al. |
| 3,711,344 | A | 1/1973 | Pierce |
| 3,715,248 | A | 2/1973 | Swotinsky et al. |
| 3,725,516 | A | 4/1973 | Kaufman |
| 3,808,061 | A | 4/1974 | Pierce |
| 3,896,731 | A | 7/1975 | Comfort et al. |
| 3,905,846 | A | 9/1975 | Berta |
| 3,938,440 | A | 2/1976 | Dooley et al. |
| 3,956,890 | A | 5/1976 | Davis |
| 3,961,576 | A | 6/1976 | Montgomery, Jr. |
| 3,962,865 | A | 6/1976 | McCone, Jr. |
| 3,995,559 | A | 12/1976 | Bice |
| 4,013,743 | A | 3/1977 | Blasche, Jr |
| 4,115,999 | A | 9/1978 | Diebold |
| 4,475,461 | A | 10/1984 | Durrell |
| 4,615,270 | A | 10/1986 | Bell |
| 4,651,254 | A | 3/1987 | Brede et al. |
| 4,756,251 | A | 7/1988 | Hightower, Jr. et al. |
| 4,823,699 | A | 4/1989 | Farinacci |
| 4,823,701 | A | 4/1989 | Wilhelm |
| 4,875,948 | A | 10/1989 | Verneker |
| 4,963,203 | A | 10/1990 | Halcomb et al. |
| 4,996,922 | A | 3/1991 | Halcomb |
| 5,030,301 | A | 7/1991 | Stout et al. |
| 5,076,868 | A | 12/1991 | Doll et al. |
| 5,080,017 | A | 1/1992 | Asikainen |
| 5,237,927 | A | 8/1993 | Gonzalez |
| 5,266,132 | A | 11/1993 | Danen et al. |
| 5,320,043 | A | 6/1994 | Andre et al. |
| 5,322,018 | A | 6/1994 | Hadden |
| 5,363,768 | A | 11/1994 | Solberg |
| 5,378,499 | A | 1/1995 | Martin et al. |
| 5,589,661 | A | 12/1996 | Menke et al. |
| 5,721,392 | A | 2/1998 | Chan |
| 5,773,748 | A | 6/1998 | Makowiecki |
| 5,801,325 | A | 9/1998 | Willer et al. |
| 5,817,970 | A | 10/1998 | Feierlein |
| 5,854,439 | A | 12/1998 | Almstrom et al. |
| 5,879,519 | A | 3/1999 | Seeser et al. |
| 6,090,756 | A | 7/2000 | Brown |
| 6,158,348 | A | 12/2000 | Campoli |
| 6,176,950 | B1 | 1/2001 | Wood et al. |
| 6,183,569 | B1 | 2/2001 | Mohler |
| 6,328,856 | B1 | 12/2001 | Seeser et al. |
| 6,334,394 | B1 | 1/2002 | Zimmerman et al. |
| 6,363,853 | B1 | 4/2002 | Rohr |
| 6,364,975 | B1 | 4/2002 | Fleming et al. |
| 6,599,379 | B2 | 7/2003 | Hiskey et al. |
| 6,627,013 | B2 | 9/2003 | Carter, Jr. et al. |
| 6,679,960 | B2 | 1/2004 | Jones |
| 6,692,655 | B1 | 2/2004 | Martins et al. |
| 6,712,917 | B2 | 3/2004 | Gash et al. |
| 6,740,180 | B1 | 5/2004 | Cesaroni |
| 6,805,832 | B2 | 10/2004 | Mohler et al. |
| 6,843,868 | B1 | 1/2005 | Fawls et al. |
| 6,962,112 | B1 | 11/2005 | Kern |
| 7,770,380 | B2 | 8/2010 | Dulligan et al. |
| 7,886,668 | B2 | 2/2011 | Hugus et al. |
| 7,896,988 | B2 | 3/2011 | Mohler |
| 7,918,163 | B2 | 4/2011 | Dahlberg |
| 7,955,451 | B2 | 6/2011 | Hugus et al. |
| 7,958,823 | B2 | 6/2011 | Sawka |
| 7,998,290 | B2 | 8/2011 | Sheridan et al. |
| 8,202,377 | B2 | 6/2012 | Erickson et al. |
| 8,298,358 | B1 | 10/2012 | Coffey et al. |
| 8,454,769 | B2 | 6/2013 | Erickson et al. |
| 8,465,608 | B1 | 6/2013 | Coffey et al. |
| 8,505,427 | B2 | 8/2013 | Wilson et al. |
| 8,524,018 | B2 | 9/2013 | Busky et al. |
| 8,544,387 | B2 | 10/2013 | Dahlberg |
| 8,591,676 | B2 | 11/2013 | Coffey et al. |
| 8,641,842 | B2 | 2/2014 | Hafner et al. |
| 8,758,580 | B2 | 6/2014 | DeVito |
| 9,255,775 | B1 | 2/2016 | Rubin |
| 9,464,874 | B1 | 10/2016 | Mohler et al. |
| 9,709,366 | B1 | 7/2017 | Mohler et al. |
| 9,816,792 | B1 | 11/2017 | Mohler et al. |
| 10,254,090 | B1 | 4/2019 | Mohler et al. |
| 10,415,938 | B2 | 9/2019 | Mohler et al. |
| 10,882,799 | B2 | 1/2021 | Coffey et al. |
| 10,989,510 | B2 | 4/2021 | Mohler et al. |
| 11,112,222 | B2 | 9/2021 | Coffey et al. |
| 11,650,037 | B2 * | 5/2023 | Yates ..... C06B 33/00 102/430 |
| 2002/0092438 | A1 | 7/2002 | Makowiecki |
| 2006/0011276 | A1 | 1/2006 | Grix et al. |
| 2006/0278119 | A1 | 12/2006 | Shilliday et al. |
| 2007/0099335 | A1 | 5/2007 | Gangopadhyay et al. |
| 2007/0169862 | A1 | 7/2007 | Hugus et al. |
| 2007/0272112 | A1 | 11/2007 | Nielson et al. |
| 2008/0028922 | A1 | 2/2008 | Wilson |
| 2008/0047453 | A1 | 2/2008 | Dahlberg |
| 2008/0134924 | A1 | 6/2008 | Sawka |
| 2009/0139422 | A1 | 6/2009 | Mohler |
| 2009/0178741 | A1 | 7/2009 | Xun et al. |
| 2010/0193093 | A1 | 8/2010 | Coffey et al. |
| 2010/0251694 | A1 | 10/2010 | Hugus et al. |
| 2010/0282115 | A1 | 11/2010 | Sheridan et al. |
| 2011/0067789 | A1 | 3/2011 | Grix et al. |
| 2011/0259230 | A1 | 10/2011 | Sawka et al. |
| 2011/0308416 | A1 | 12/2011 | Bar et al. |
| 2012/0103479 | A1 | 5/2012 | Katzakian et al. |
| 2012/0132096 | A1 | 5/2012 | Chin et al. |
| 2013/0305950 | A1 | 11/2013 | Coffman, II |
| 2014/0237879 | A1 | 8/2014 | Mirabile |
| 2016/0102030 | A1 | 4/2016 | Coffey et al. |
| 2016/0216095 | A1 | 7/2016 | Rami |
| 2019/0128656 | A1 | 5/2019 | Mohler et al. |
| 2020/0232772 | A1 | 7/2020 | Coffey et al. |
| 2020/0400415 | A1 | 12/2020 | Mohler et al. |
| 2022/0260353 | A1 | 8/2022 | Yates |
| 2024/0238956 | A1 * | 7/2024 | Mohler ..... B25C 1/143 |

FOREIGN PATENT DOCUMENTS

| | | | |
|---|---|---|---|
| GB | 885409 | A | 12/1961 |
| GB | 944442 | A | 12/1963 |
| GB | 987332 | A | 3/1965 |
| GB | 994184 | A | 6/1965 |
| WO | 2005121055 | A1 | 12/2005 |
| WO | WO-2025085106 | A2 * | 4/2025 ..... F42C 19/0803 |

OTHER PUBLICATIONS

International Written Opinion for PCT/US2024/026858 dated Apr. 30, 2025.

Zirconium, Wikipedia, https://en.wikipedia.org/wiki/Zirconium, dated at least as early as Jan. 1, 2021.

Zirconium Carbide, Wikipedia, https://en.wikipedia.org/wiki/Zirconium_carbide, dated at least as early as Jan. 1, 2021.

K. Woll et al., The utilization of metal/metal oxide core shell powders to enhance the reactivity of diluted thermite mixtures, Combustion and Flame 167 (2016) 259-267.

A. H. Kinsey et al., Gas Suppression via Copper Interlayers in Magnetron Sputtered Al—Cu2O Multilayers, ACS Applied Materials & Interfaces, 2017, 22026-22036.

Aluminum Carbide, Wikipedia, https://en.wikipedia.org/wiki/Aluminium_carbide, dated at least as early as Jan. 1, 2021.

(56) References Cited

OTHER PUBLICATIONS

K. J. Blobaum et al., Deposition and characterization of a self-propagating CuOx/Al thermite reaction in a multilayer foil geometry, J. Appl. Phys., vol. 94, No. 5, 2003.
Carbide, Wikipedia, https://en.wikipedia.org/wiki/Carbide, dated at least as early as Jan. 1, 2021.
Ceramic, Wikipedia, https://en.wikipedia.org/wiki/Ceramic, dated at least as early as Jan. 1, 2021.
Detonator, Wikipedia, https://en.wikipedia.org/wiki/Detonator, dated at least as early as Jan. 1, 2021.
High Power Impulse Magnetron Sputtering, Wikipedia, https://en.wikipedia.org/wiki/High-power_impulse_magnetron_sputtering, dated at least as early as Jan. 1, 2021.
J. L. Gottfried, Improving the Explosive Performance of Aluminum Nanoparticles with aluminum lodate Hexahydrate (AIH), 2018, https://www.nature.com/articles/s41598-018-26390-9.
G. C. Egan et al., Probing the Reaction Dynamics of Thermite Nanolaminates, J. Phys. Chem. 119, 2015, 20401-20408.
Thermite, Wikipedia, https://en.wikipedia.org/wiki/Thermite, dated at least as early as Jan. 1, 2021.
Titanium Carbide, Wikipedia, https://en.wikipedia.org/wiki/Titanium_carbide, dated at least as early as Jan. 1, 2021.
Versatile Reactive Sputtering Batch Drum Coater With Auxiliary Plasma, Deposition Sciences, Inc., 2004.

* cited by examiner

FUZZY INTERFACE LAYER FOR THERMITE AND PRIMER MADE FROM THERMITE WITH FUZZY LAYER

CROSS REFERENCE TO RELATED APPLICATION

This application claims the benefit of U.S. provisional patent application Ser. No. 63/462,995, which was filed on Apr. 29, 2023, and entitled "Fuzzy Interface Layer For Thermite And Primer Made From Thermite With Fuzzy Layer."

TECHNICAL FIELD

The present invention relates to primers for firearms and other munitions. More specifically, a primer made from layered metal oxide and reducing metal with a fuzzy interface layer between the reducing metal and metal oxide is provided BACKGROUND INFORMATION Cartridges for firearms, as well as other munitions such as larger projectile cartridges and explosives are often ignited by a primer. Presently available primers and detonators are made from a copper or brass alloy cup with a brass anvil and containing lead azide or lead styphnate. When the base of the cup is struck by a firing pin, the priming compound is crushed between the cup's base and the anvil, igniting the primer charge. The burning primer then ignites another flammable substance such as smokeless powder, explosive substances, etc. Lead azide and lead styphnate are hazardous due to their toxicity as well as their highly explosive nature. Additionally, present manufacturing methods are very labor-intensive, with the necessary manual processes raising costs, causing greater difficulty in maintaining quality control.

Energetic materials such as thermite are presently used when highly exothermic reactions are needed. Uses include cutting, welding, purification of metal ores, and enhancing the effects of high explosives. A thermite reaction occurs between a metal oxide and a reducing metal. Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The reducing metal may also be in the form of an alloy or intermetallic compound of the above-listed metals.

The reducing metals used within energetic materials will oxidize if exposed to oxygen or to water vapor. Prior art thermite structures attempted to balance the increased ignition rate of having the reducing metal and metal oxide more finely divided with the reduced energy density which results from a greater portion of the reducing metal oxidizing prior to ignition. For example, in a layered thermite composite, thinner layers within a composite having the same overall thickness will typically have a faster ignition rate but a lower energy density than a composite having thicker layers of reactants. One prior art reference, US 2002/0092438, attempted to characterize the gradual increase of the size of the interface layer over time as a positive feature, claiming it could be used to limit the lifespan of a primer for ammunition. Minimizing the thickness of the reducing metal oxide interface layer, and/or changing the composition of the interface layer can permit increased ignition rates without compromising energy density. Particularly when such a thermite composite is deposited on a malleable substrate, a thin interface layer and/or an interface layer which includes reactant atoms as well as reducing metal oxide atoms at least partially intermixed therein could aid in susceptibility to mechanical ignition.

Accordingly, there is a need for a primer made from materials that do not share the toxicity of lead. There is an additional need for a layered thermite composite having interface layers between reactants which do not significantly impact energy density or susceptibility to mechanical ignition. There is a further need for a primer made from materials that lend themselves to automated processes, as well as processes which protect the reducing metal from oxidizing during and after deposition. Another need exists for a primer made from energetic materials that lends itself to ignition through a strike by a firing pin, but which otherwise benefits from the stability of thermite.

SUMMARY

The above needs are met by a layered thermite composite. The thermite composite comprises a substrate having a deposition surface and a rear surface. Alternating layers of metal oxide and reducing metal are deposited upon the substrate. The alternating layers of metal oxide and reducing metal are structured to react with each other in response to an impact applied to the rear surface of the substrate. The thermite composite further comprises a fuzzy interface layer disposed between each metal oxide layer and reducing metal layer. The fuzzy interface layer contains reducing metal, reducing metal oxide, and metal oxide which are at least partially mixed together.

The above needs are further met by a primer. The primer comprises a substrate having a deposition surface and a rear surface. The primer further has alternating layers of metal oxide and reducing metal deposited upon the substrate. The alternating layers of metal oxide and reducing metal are structured to react with each other in response to an impact applied to the rear surface of the substrate. The primer also comprises a fuzzy interface layer disposed between each metal oxide layer and reducing metal layer. The fuzzy interface layer contains reducing metal, reducing metal oxide, and metal oxide which are at least partially mixed together.

The above needs are additionally met by a cartridge for a firearm. The cartridge comprises a casing having a front end, a back end, and a hollow interior. A bullet is secured within the front end of the casing. Aa propellant is disposed within the hollow interior. A primer is secured within the back end of the casing. The primer is in communication with the propellant. The primer comprises a substrate having a deposition surface and a rear surface. The primer further has alternating layers of metal oxide and reducing metal deposited upon the substrate. The alternating layers of metal oxide and reducing metal are structured to react with each other in response to an impact applied to the rear surface of the substrate. The primer also has a fuzzy interface layer disposed between each metal oxide layer and reducing metal layer. The fuzzy interface layer contains reducing metal, reducing metal oxide, and metal oxide which are at least partially mixed together.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
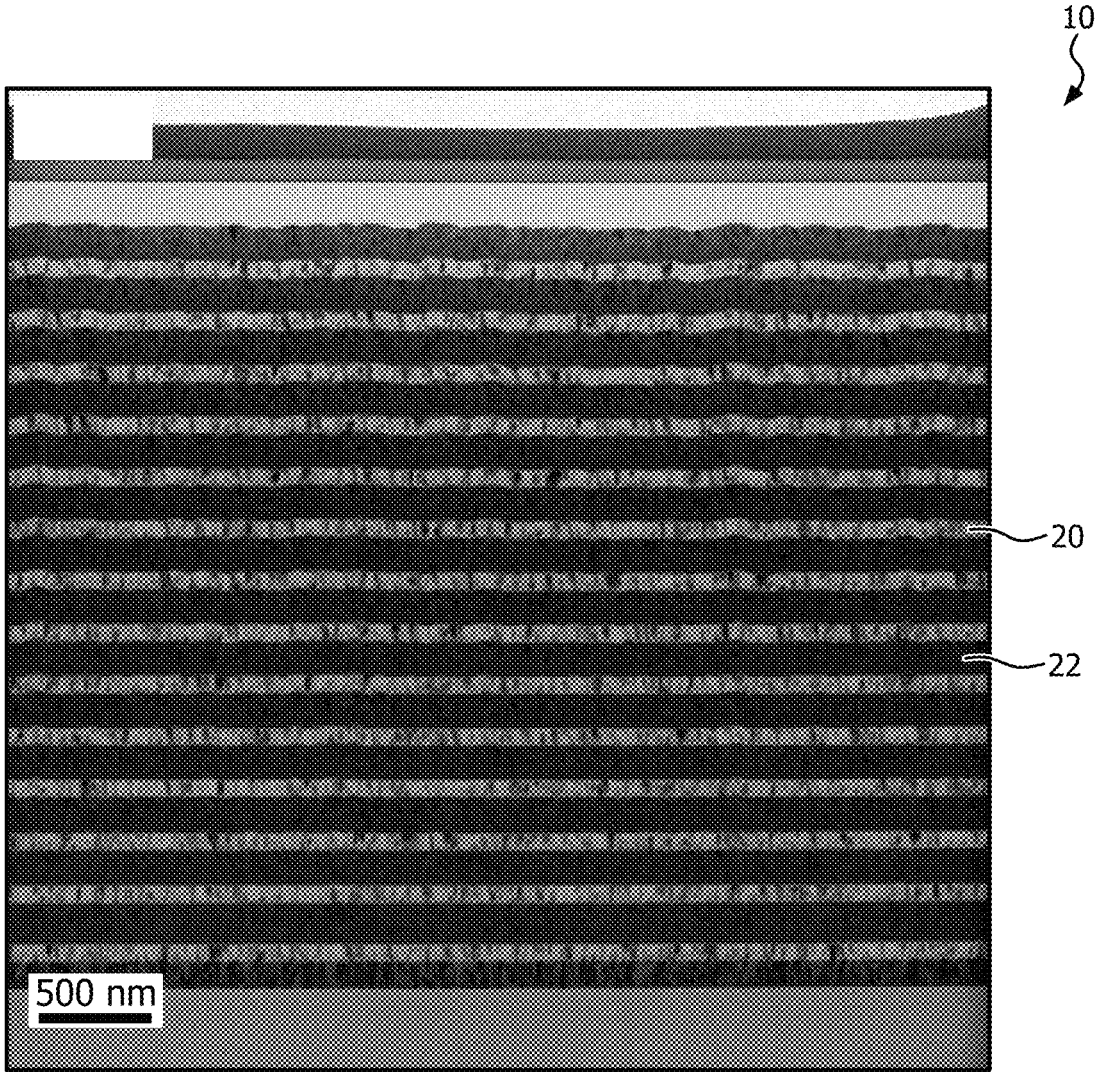
FIG. 1 a sectional, side elevational view of an example of a layered thermite composite according to the present invention.

Referring to FIGS. 1-4, a layered thermite composite 10 is shown. The layered thermite composite is particularly useful as a portion of a primer 14, as well as for other uses. The layered thermite composite 10 is deposited upon a substrate 12. The layered thermite composite 10 may include one or more carbide-containing ceramic layer(s) 16 within the layered thermite coating 14, and includes a passivation coating 18.

Figure 4:
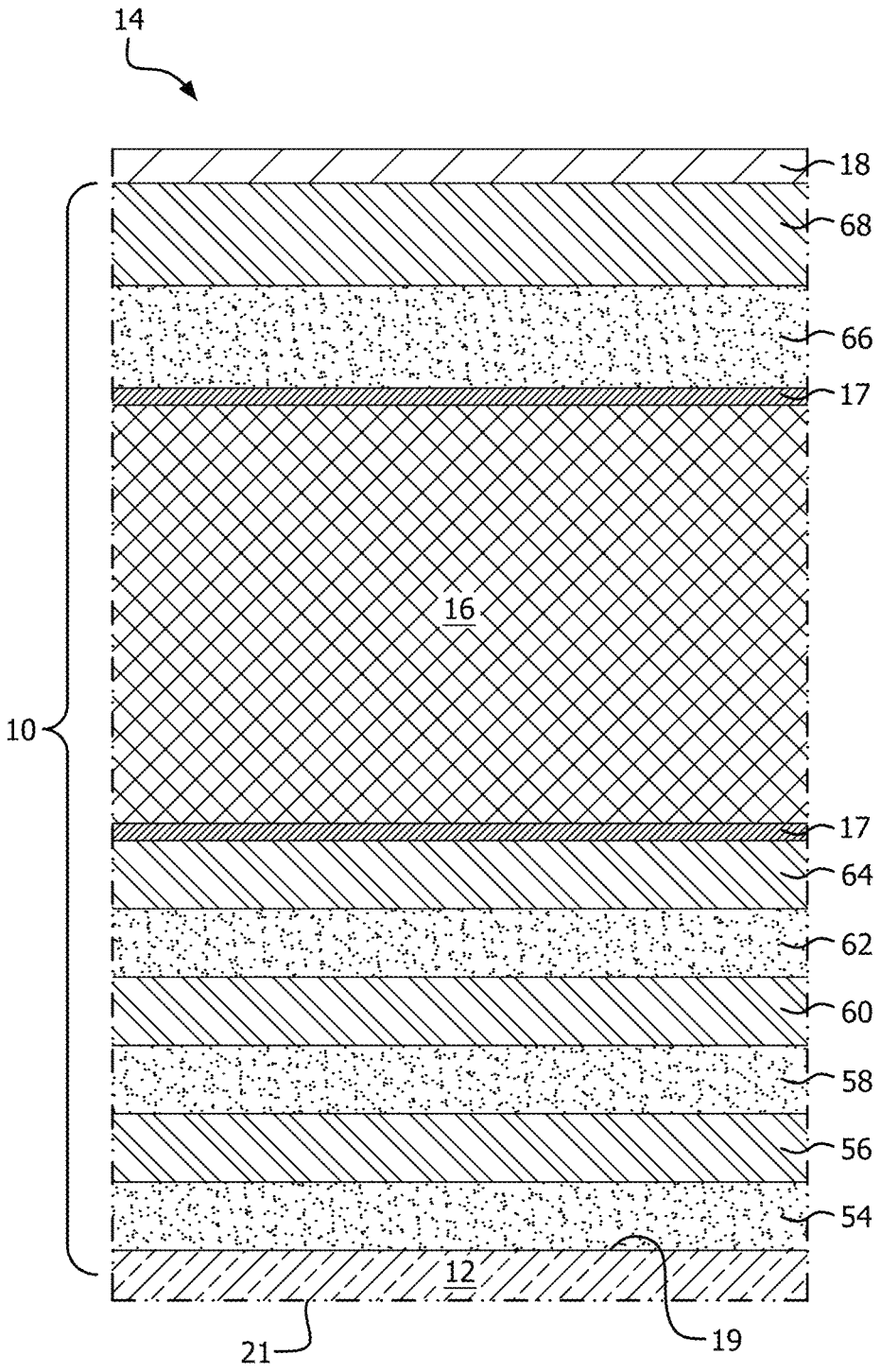
FIG. 4 is a sectional, side elevational view of another alternative layered thermite composite, a carbide-containing ceramic layer, and passivation coating of a primer.

If the thermite composite 10 is within a primer 14, then the substrate 12 in the illustrated example is a malleable disk, made from a material such as brass, copper, soft steel, and/or stainless steel, having a deposition surface 19 upon which the layered thermite coating 10 is deposited, and a rear surface 21 (FIG. 4). The substrate 12 is a sufficiently thin and malleable so that a firing pin strike to the rear surface 21 will ignite the layered thermite coating 10 and carbide-containing ceramic layer(s) 16 as described below, but is sufficiently thick for ease of manufacturing the primer 14 as well as securing a primer 14 within a cartridge case, munition, modified primer cup, or other location as described below. A preferred substrate thickness is about 0.005 inch to about 0.1 inch, and is more preferably about 0.01 to about 0.025 inch.

The layered thermite coating 14 includes alternating layers of metal oxide and reducing metal (with only a small number of layers illustrated for clarity). Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The metal oxide and reducing metal are preferably selected to resist abrasion or other damage to a barrel of a firearm with which a cartridge containing the primer is used by avoiding reaction products which could potentially cause such damage. One example of such a combination of metal oxide and reducing metal is cupric oxide and magnesium.

The thickness of each metal oxide layer and reducing metal layer are determined to ensure that the proportions of metal oxide and reducing metal are such so that both will be substantially consumed by the exothermic reaction. As one example, in the case of a metal oxide layer 20 made from CuO and reducing metal layer 22 made from Al (FIG. 1), the chemical reaction is $3CuO+2Al \rightarrow 3Cu+Al_2O_3$+heat. The reaction therefore requires 3 moles of CuO, weighing 79.5454 grams/mole, for every 2 moles of Al, weighing 26.98154 grams/mole. CuO has a density of 6.315 g/cm$^3$, and aluminum has a density of 2.70 g/cm$^3$. Therefore, the volume of CuO required for every 3 moles is 37.788 cm$^3$. Similarly, the volume of Al required for every 2 moles is 19.986 cm$^3$. Therefore, within the illustrated example of a composite layer 16, the metal oxide 12 is about twice as thick as the reducing metal 14.

As another example, in the case of a metal oxide layer 20 made from CuO and reducing metal layer 22 made from Mg, the chemical reaction is $CuO+Mg \rightarrow Cu+MgO$+heat. The reaction therefore requires one mole of CuO, weighing 79.5454 grams/mole, for every one mole of Mg, weighing 24.305 grams/mole. CuO has a density of 6.315 g/cm$^3$, and magnesium has a density of 1.74 g/cm$^3$. Therefore, the volume of CuO required for every mole is 12.596 cm$^3$. Similarly, the volume of Mg required for every mole is 13.968 cm$^3$. Therefore, within the illustrated example, each layer of metal oxide is about the same thickness or slightly thinner than the corresponding layer of reducing metal. If other metal oxides and reducing metals are selected, then the relative thickness of the metal oxide and reducing metal can be similarly determined.

Figure 5:
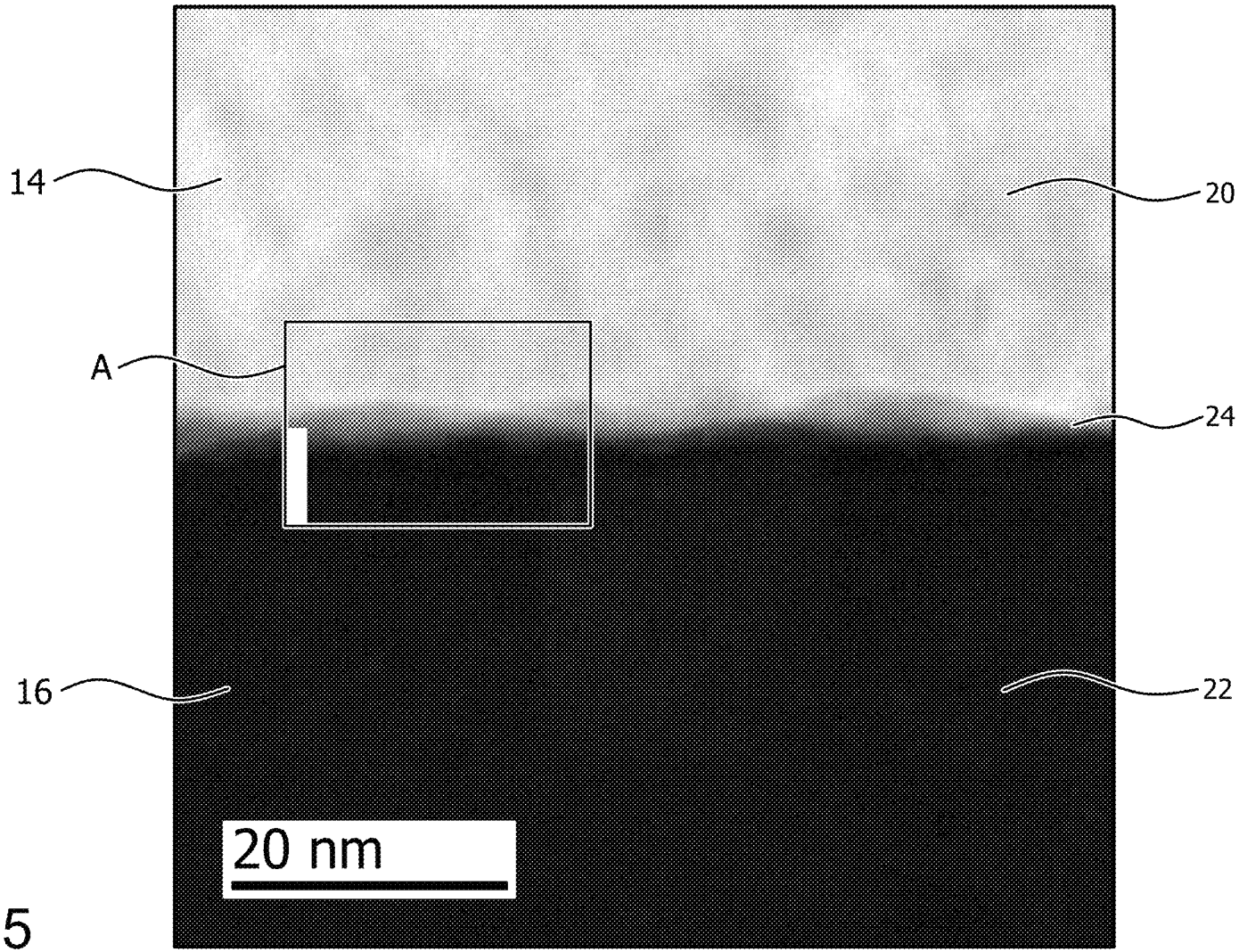
FIG. 5 is a sectional, side elevational view of a fuzzy interface layer between a metal oxide layer and a reducing metal layer of the thermite structure of FIG. 1.
Figure 6A:
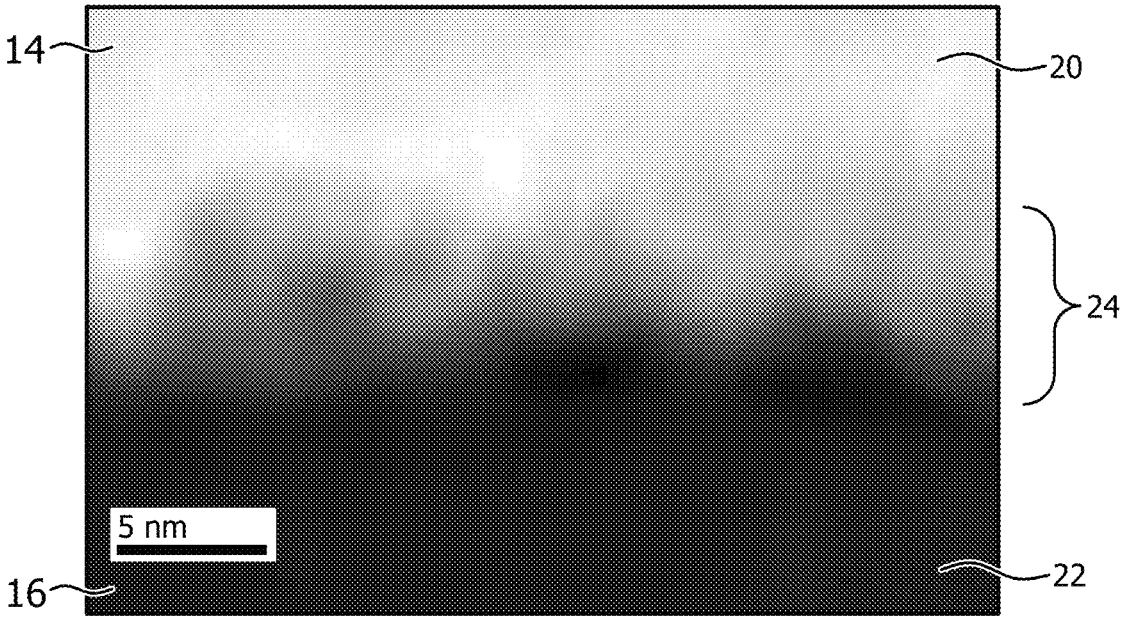
FIG. 6A is a sectional, side elevational view of the box A in FIG. 5.
Figure 6B:
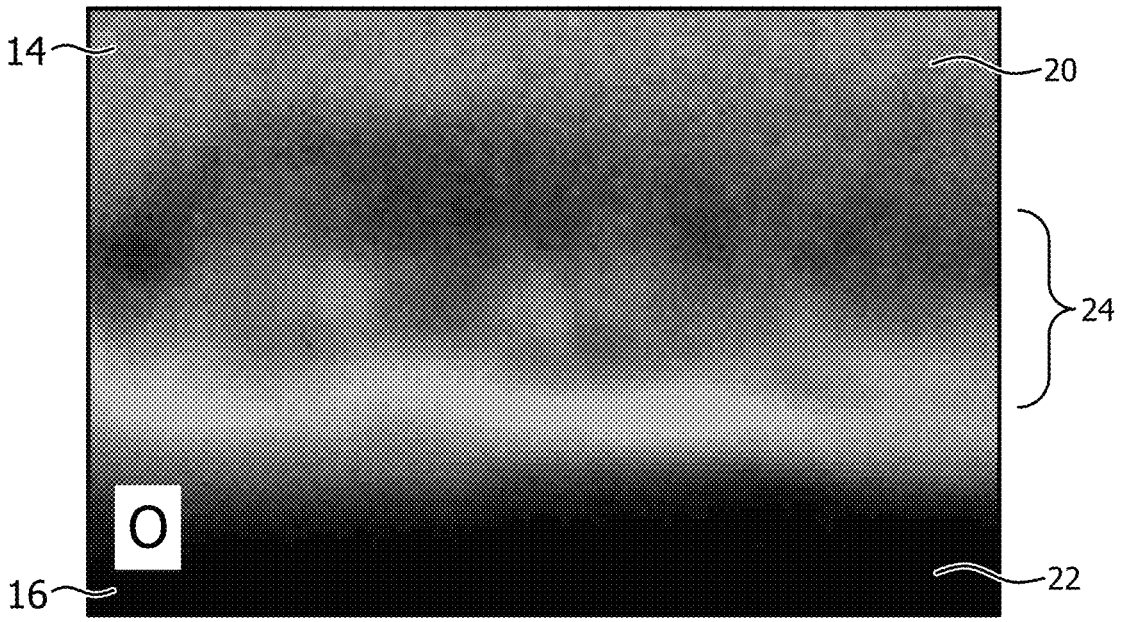
FIG. 6B is a sectional, side elevational view of the box A in FIG. 5, showing the oxygen content within the box A of FIG. 5.
Figure 6C:
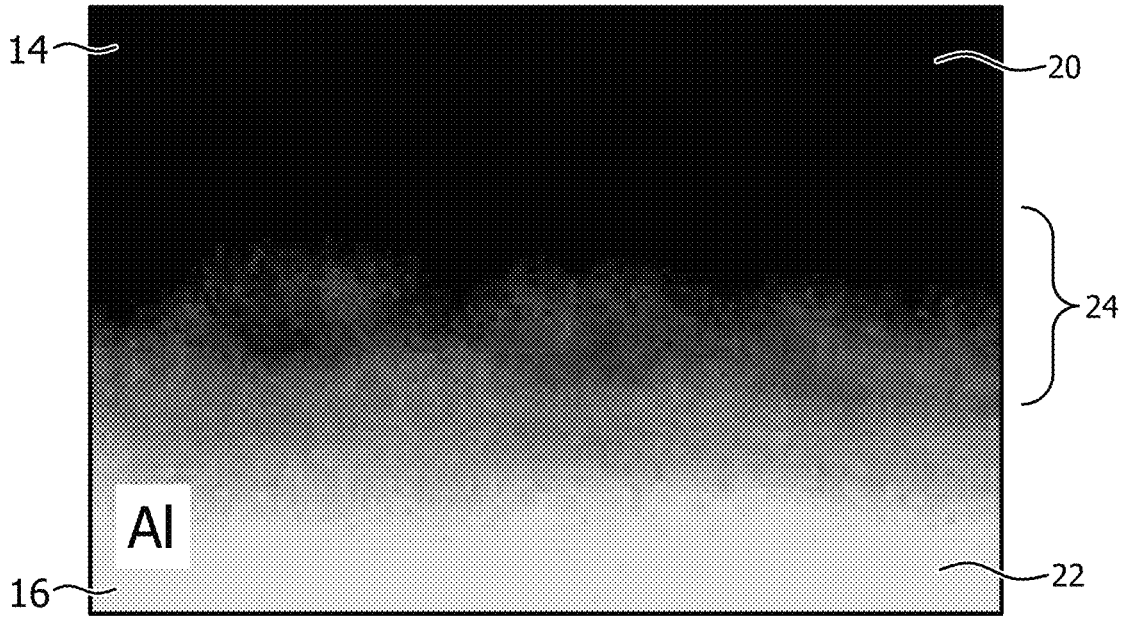
FIG. 6C is a sectional, side elevational view of the box A in FIG. 5, showing the aluminum content within the box A of FIG. 5.
Figure 6D:
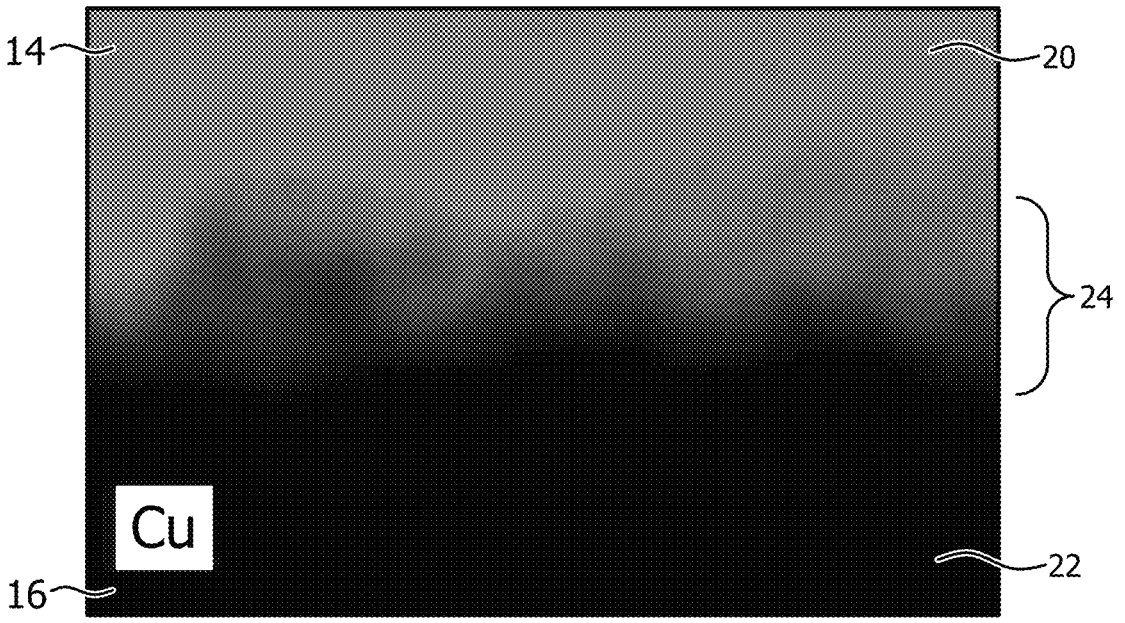
FIG. 6D is a sectional, side elevational view of the box A in FIG. 5, showing the copper content within the box A of FIG. 5.

Referring to FIGS. 5-6D, the illustrated example of the thermite structure 10 also includes a fuzzy interface layer 24 between each reducing metal layer 16 and adjacent metal oxide layer 14. As used herein, a fuzzy interface layer 24 is an interface between a reducing metal layer 16 and a metal oxide layer 14, with the interface layer 24 containing metal oxide 20, reducing metal 22, and reducing metal oxide, all of which are at least partially intermixed to form a gradient structure within the interface layer 24. (Due to the intermixing of materials at the interface layer 24, reference characters 14 and 16 refer to metal oxide layers and reducing metal layers, respectively, while reference characters 20 and 22 refer to metal oxide and reducing metal, respectively, regardless of whether those materials are within a layer 14 or 16.) Although the approximate thickness of the fuzzy interface layer 24 is about 2 nm to about 5 nm, the fuzzy interface layer 24 does not have precise boundaries. Instead, the amount of each material present in and around the fuzzy interface layer 24 will be a gradient with respect to proximity to either the reducing metal layer 16 or metal oxide layer 14. As shown in the example of FIG. 5, moving from the bottom of the image to the top, the material transitions from aluminum 22 within the reducing metal layer 16, to a combination of aluminum 22, aluminum oxide, and cupric oxide 20 as the interface layer 24 within the approximate center of the image is reached. Continuing upward in the image, the material again transitions from the mixture of aluminum 22, aluminum oxide, and cupric oxide 20 in the interface layer 24 to simply cupric oxide in the metal oxide layer 14.

Figure 7:
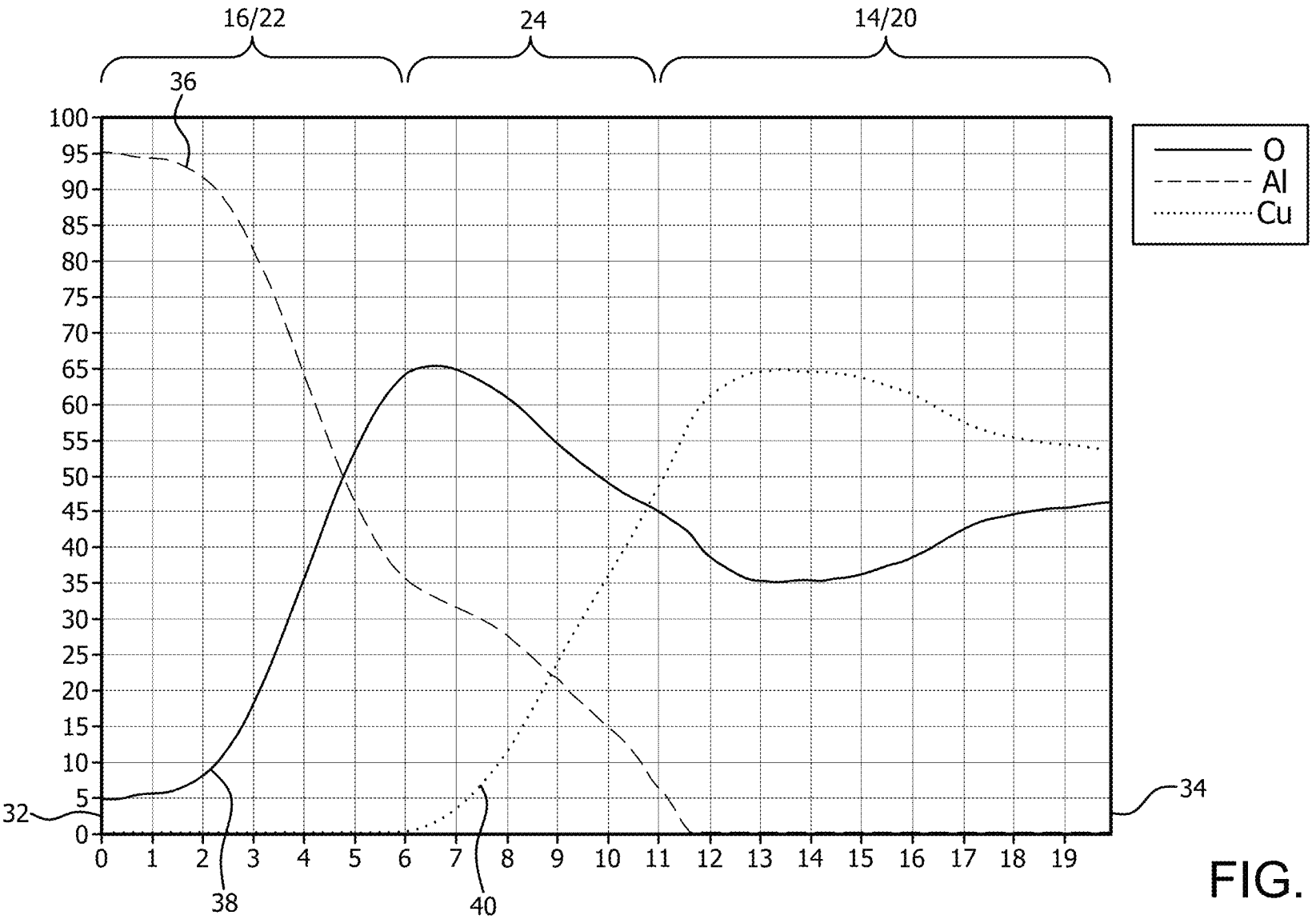
FIG. 7 is a graph showing the atomic percent of aluminum, oxygen, and copper with respect to position within the fuzzy interface of FIGS. 5-6D.

A similar gradient pattern is shown in the examples of FIGS. 6A-6D, with FIG. 6A simply showing the detail of box A in FIG. 5. FIG. 6B focuses on the oxygen 26 present within Box A. In FIG. 6B, the aluminum layer 16 contains no oxygen 26, but oxygen in relatively high concentration (appearing as a lighter shade) is present above the aluminum 28 within the interface 24. Cupric oxide 20 is present above the oxygen 26 in relatively high concentration within the layer 24 as well as the layer 16. FIG. 6C focuses on aluminum 28 (shown in a lighter shade), showing the transition between pure aluminum within the layer 16, to a mixture of aluminum 28 and other elements in the interface 24, and no aluminum 28 in the layer 14. Similarly, FIG. 6D focuses on the copper 30 (shown in a lighter shade), showing no copper 30 in the layer 16, some copper 30 in the interface 24, and a large percentage of copper 30 in the layer 14. The atomic percent of each element within box A of FIG. 5 is also graphically illustrated in FIG. 7, with the left side 32 of FIG. 7 corresponding to the bottom of the images of FIGS. 5-6D, and the right side 34 of FIG. 7 corresponding to the top of the images 5-6D. Line 36 shows aluminum, line 38 shows oxygen, and line 40 shows copper. As shown in FIG. 7 the atomic percent aluminum is maximized on the left side 32, decreasing towards zero at some position within the layer 24. The atomic percentage of oxygen (within aluminum oxide and cupric oxide) is very small in the layer 16, but becomes high in the layer 24, and decreases to a stable percentage within the layer 14. Copper (in the form of cupric oxide) is absent from the layer 16, but increases as the layer 24 is entered, increasing throughout the layer 24 until stabilizing in the layer 14. Although other examples of fuzzy interface layers will follow similar patterns, variation will occur in the location of the transitions, atomic percent of each element at various locations, and the overall thickness of the fuzzy interface layer.

The interface layer 24 forms between completion of depositing one layer of reducing metal 16 or metal oxide 14 and the beginning of deposition of the next layer of reducing metal 16 or metal oxide 14. Prior art interface layers would form as the surface of the reducing metal oxidized from exposure to atmospheric oxygen or water vapor, and were thus composed of reducing metal oxide. The fuzzy interface layer described herein is formed by a process (described in greater detail below) which permits rapid transitions from depositing one type of layer to depositing the other type of layer, permitting only a limited amount of reducing metal oxide to form during the transition between depositing reducing metal and depositing metal oxide. The resulting interface layer is therefore a gradient structure of metal oxide, reducing metal, and reducing metal oxide rather than pure reducing metal oxide.

A layered thermite composite 10 can be made using a deposition system on which the substrate is secured to a substrate support which is movable between a plurality of deposition chambers. As one example, the substrate support may use a substrate support in the form of a rotating drum having a surface on which the substrates are secured, and includes a plurality of deposition chambers positioned around the drum. Such systems are described in the following patents or published applications, the entire disclosure of all of which are expressly incorporated herein by reference: U.S. Pat. No. 8,758,580, which was issued to R. DeVito on Jun. 24, 2014; U.S. Pat. No. 5,879,519, which was issued to J. W. Seeser et al. on Mar. 9, 1999; EP 0,328,257, which was invented by M. A. Scobey et al. and published on Aug. 16, 1989, and U.S. Pat. No. 6,328,856, which was issued to J. W. Seeser et al. on Dec. 11, 2001. The use of a rotating drum system permits the substrates to be rapidly transferred between different chambers for deposition of different layers made from different materials. In one example, some chamber(s) will be used to deposit the reducing metal, other chamber(s) will be used to deposit the metal oxide, and still other chamber(s) may be used to deposit the carbide-containing ceramic (if a primer is the intended result). In a four chamber system, other chambers may be used to deposit the adhesion layers above and below the carbide-containing ceramic. One example may utilize between two and four chambers, with two targets per chamber. The atmospheric conditions within each chamber are maintained and isolated from other portions of the system by baffles which extend close to the drum while maintaining separation from the substrates. Substrates may thereby be moved between chambers by rotating the drum upon which the substrates are located while maintaining the correct pressure and atmospheric conditions of each chamber throughout the process of depositing multiple layers. During the process of depositing metal oxide and reducing metal, the individual chambers will run continuously, and the drum or other substrate carrier will rotate or otherwise move continuously to move the substrates through the appropriate chambers at the appropriate rate. Additionally, the pressure of an inert gas, for example, argon in the chamber utilized to deposit reducing metal may be greater than the pressure in the chamber utilized to deposit metal oxide, thus resisting the entry of oxygen into the reducing metal chamber. The need to pump down each chamber between layers of different material is thus avoided, speeding and simplifying the deposition process.

Prior art manufacturing methods typically required several minutes of deposition time for each of the reducing metal or metal oxide layers, with multiple minutes of additional time required to switch from depositing one material to depositing the other material. The above-described process permits each layer to be deposited in a time of, for example, about 15 seconds. Transitioning from one chamber to the next chamber can be accomplished in a time of, for example, about 2 seconds. The manufacturing process is thus significantly faster, as well as providing very little time for interface layers having undesirable characteristics to form. Without being bound by any particular theory, it is believed that the oxygen which reacts with the reducing metal during transitions between chambers is atmospheric oxygen and/or oxygen from the deposition of the metal oxide rather than oxygen from water vapor. Again without being bound by any particular theory, it is believed that interface layers formed by reactions with water vapor are more likely to grow over time through additional reaction with and oxidation of the reducing metal. Interfaces formed by reactions with atmospheric oxygen and/or oxygen from the deposition of metal oxide will resist additional metal oxide formation once the interface is covered by the next layer of reactant. Because the fuzzy interface layer 24 will not grow over time, and because the fuzzy interface region includes not only reducing metal oxide but also metal oxide and reducing metal, the metal oxide and reducing metal remain in sufficiently close proximity to each other so that they can be ignited electrically or mechanically when desired.

If the thermite structure is intended for use as a primer 14, then some examples of the primer 14 may include elements which will either facilitate ignition and/or facilitate carrying the ignition to a propellant within a cartridge casing or to another ignitable material, for example, a fuse which is intended for ignition by the primer.

Figure 2:
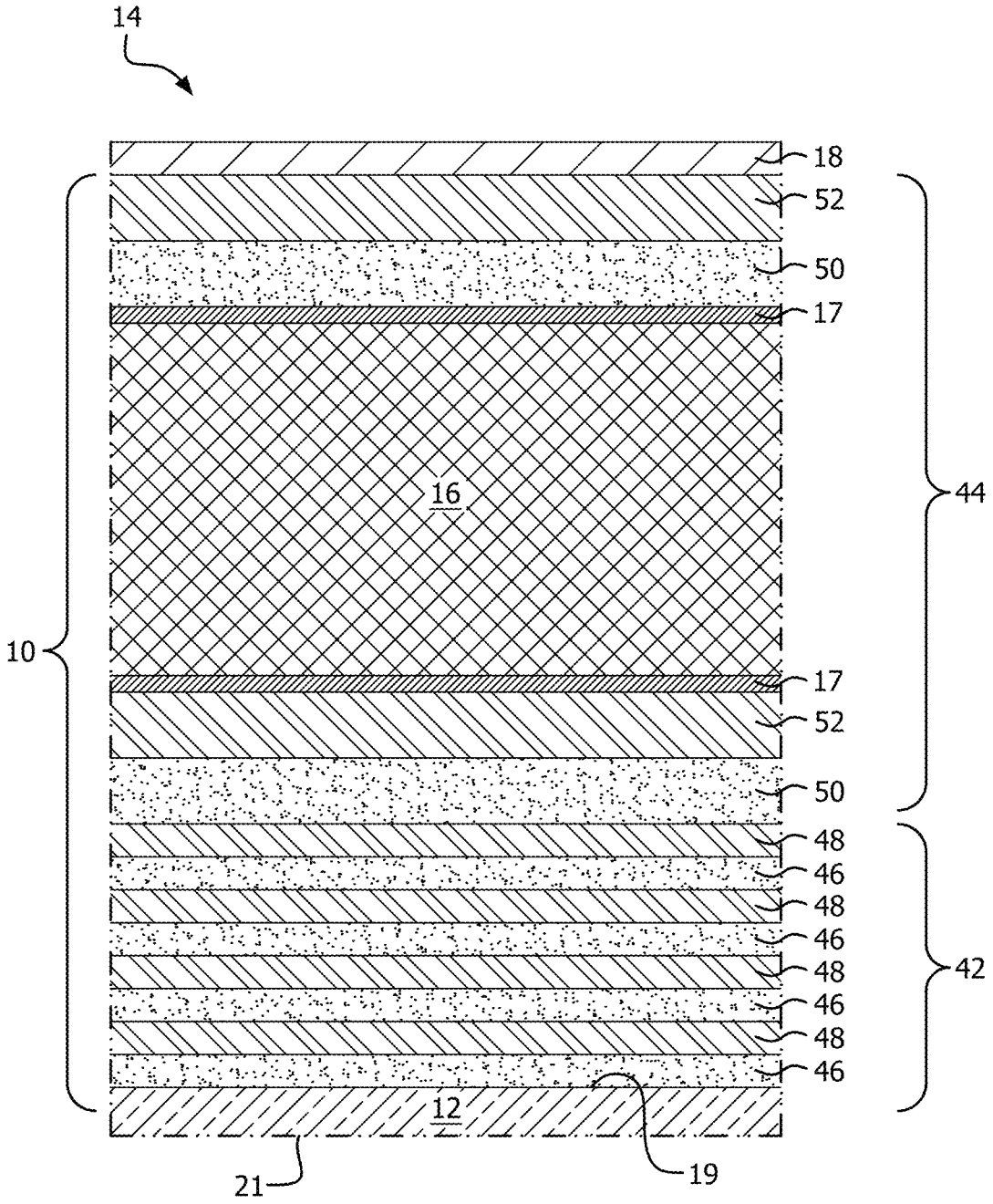
FIG. 2 is a sectional, side elevational view of a layered thermite composite, a carbide-containing ceramic layer, and passivation coating of a primer.
Figure 3:
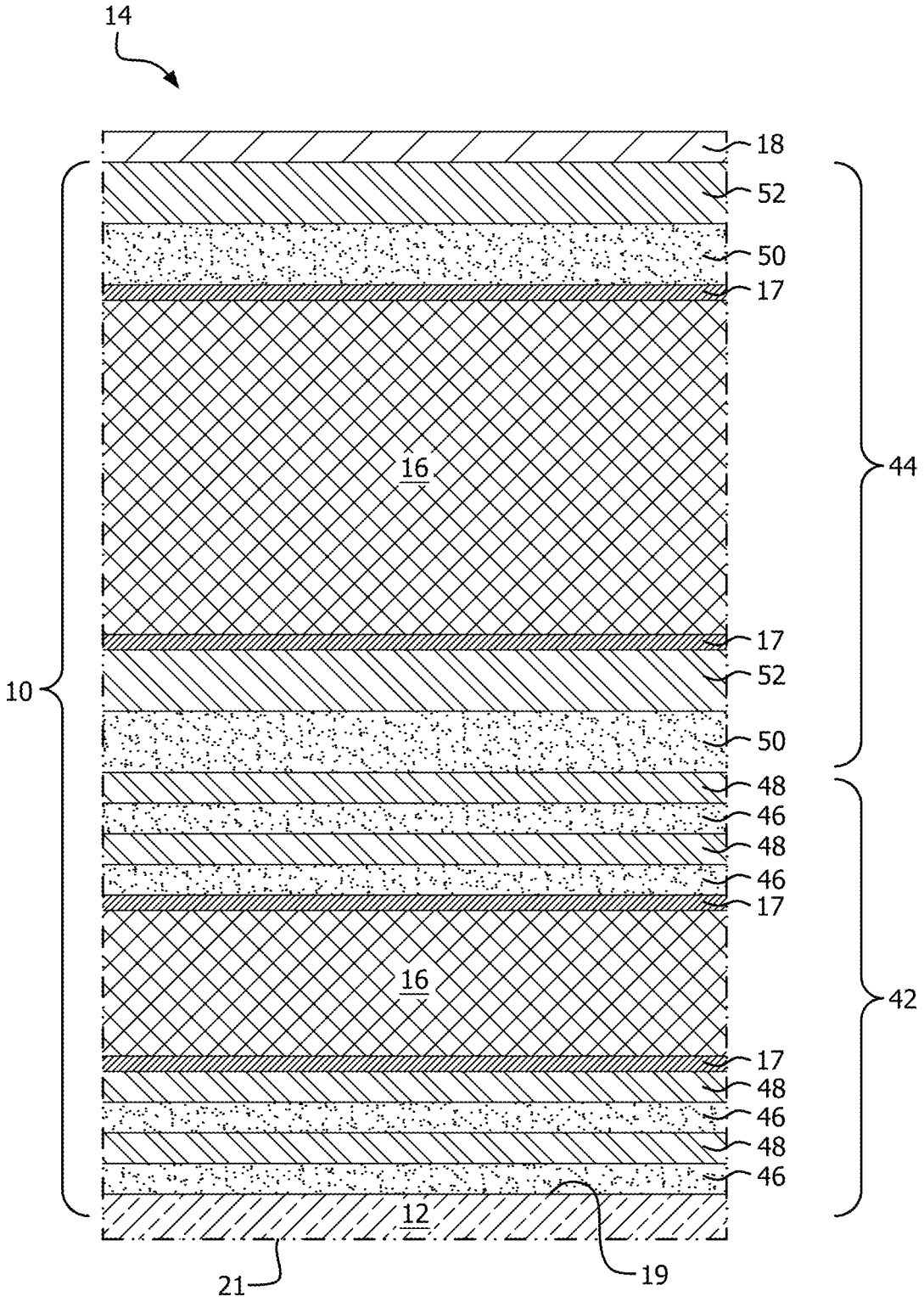
FIG. 3 is a sectional, side elevational view of an alternative layered thermite composite, a pair of carbide-containing ceramic layers, and passivation coating of a primer.

The illustrated example in FIGS. 2 and 3 of a layered thermite coating 14 is divided into an initial ignition portion 42 that is deposited directly onto the substrate 12, and a secondary ignition portion 44 that is deposited onto the initial ignition portion 42. The illustrated example of the initial ignition portion 42 includes layers of metal oxide 46 and reducing metal 48 that are thinner than the layers of metal oxide 50 and reducing metal 52 within the secondary ignition portion 44. In the illustrated example, each metal oxide 46 and reducing metal 48 pair of layers are preferably between about 20 nm and about 100 nm thick, with the illustrated example having pairs of layers that are about 84 nm thick. In the illustrated example, each pair of metal oxide 50 and reducing metal 52 layers are thicker than about 100 nm thick. Thinner layers result in more rapid burning and easier ignition, while thicker layers provide a slower burn rate. The thinner layers 46, 48 within the initial ignition portion 42 are more sensitive to physical impacts, thereby facilitating ignition in response to a firing pin strike to the rear surface 21 of the substrate 12, and ignite the secondary ignition portion 44. The thicker layers 50, 52 within the secondary ignition portion 44 burn more slowly, enhancing the reliability of the ignition of the smokeless powder, explosive, or other desired ignitable substance. The total thickness of the illustrated examples of the layered thermite coating 10 is between about 25 μm and about 1,000 μm.

The illustrated example of the thermite coating 10 in FIGS. 2 and 3 shows a generally uniform thickness for all layers 46, 48 within the initial ignition portion 42. Similarly, a generally uniform thickness is shown within the layers 50, 52 within the secondary ignition portion 44. Other examples may include metal oxide and reducing metal layers having differing thicknesses. For example, FIG. 4 shows a primer composition 10 having thermite layers that increase generally proportionally with the distance of the layer from the substrate 12 (with only a small number of layers shown for clarity). Layers 54 and 56, which are close to the substrate 12, have a smaller thickness, for example, between about 20 nm and about 100 nm thick. Layers 58 and 60 have increased thickness. Layers 62 and 64, farther still from the substrate 12, have greater thickness than layers 58 and 60. Layers 66 and 68, adjacent to the passivation coating 18 and farthest from the substrate 12, are the thickest layers, and are thicker than about 100 nm thick. As before, the total thickness of the illustrated examples of the layered thermite coating 10 is between about 25 μm and about 1,000 μm. Such a thermite coating 10 would provide essentially the same advantage of rapid ignition close to the substrate 12, and relatively slower burning farther from the substrate 12 and closer to the smokeless powder, explosive, or other ignitable substance. With such gradually increasing thickness, a clear boundary between an initial ignition portion and secondary ignition portion may not exist, and a definite boundary is not essential to the functioning of the invention.

As another example, all layers of metal oxide and reducing metal may be less than about 100 nm thick, and the time required to consume all layers of metal oxide and reducing metal may be increased sufficiently to ignite conventional propellants and explosives by simply increasing the number of layers of metal oxide and reducing metal.

Other examples of the layered thermite coating 14 may include layers 46, 48, 50, 52, or layers 54, 56, 58, 60, 62, 64, 66, 68, that are deposited under different temperatures, so that each layer is deposited under a temperature which is either sufficiently higher or sufficiently lower than the adjacent layers to induce thermal expansion and contraction stresses within the layered thermite coating 10 once temperature is equalized within the layered thermite coating. Such expansion and contraction stresses are anticipated to result in increased sensitivity to ignition through a physical impact.

A passivation layer 18 covers the layered thermite coating 14, protecting the metal oxide and reducing metal within the layered thermite coating 14. One example of a passivation layer 18 is silicon nitride. Alternative passivation layers 18 can be made from reactive metals that self-passivate, for example, aluminum or chromium. When oxide forms on the surface of such metals, the oxide is self-sealing, so that oxide formation stops once the exposed surface of the metal is completely covered with oxide.

If the layered thermite composite is used for a primer for firearms or other munitions, then the layered structure may include one or more carbide-containing ceramic layer(s). The carbide-containing ceramic layer(s) 16 are disposed within the thermite layers 10. In the illustrated examples, one carbide-containing ceramic layers 16 is disposed about ⅓ of the distance to the top of the thermite coating 10. In other examples, a carbide-containing ceramic layer 16 may be located elsewhere in the thermite coating 10, such as a lower portion, a central portion, the top, the bottom, or elsewhere in the upper portion of the thermite coating 10. Some examples may include a plurality of layers carbide-containing ceramic layers 16 which are located in different positions throughout the thermite coating 10. Although one or two layers are illustrated, three or more layers may be utilized. The thickness of the carbide-containing ceramic layer(s) 16 is thicker than the metal oxide or reducing metal layers, and in the illustrated example is between about 100 nm and about 2 μm thick. Other examples of the carbide-containing ceramic layer(s) 16 may be between about 500 nm and about 1 μm thick.

Carbide-containing ceramics are selected for their propensity, when ignited by ignition of the adjacent reducing metal and metal oxide, to project relatively large (as compared to the thermite reaction products) particles into the propellant of a firearm cartridge or other ignitable or detonatable material. Examples include ceramics such as zirconium carbide, titanium carbide, or silicon carbide, as well as aluminum carbide (which is a metal-ceramic composite but will be considered to be a carbide-containing ceramic herein), and combinations thereof. If more than one carbide-containing ceramic layer is present, then the different carbide-containing ceramic layers may be composed of the same carbide-containing ceramic, or different carbide-containing ceramics. Ignition of these carbides (or other suitable carbides) will result in the formation of carbon dioxide through the reaction with oxygen from the cupric oxide. This gas production will aid in propelling the reaction products of the thermite as well as the reaction products of the carbide-containing ceramic into the propellant or other ignitable or detonatable material. The large, hot particles resulting from the reaction of the carbide-containing ceramic with oxygen will burn for a sufficient period of time to ensure reliable ignition of the propellant or other ignitable or detonatable material.

Some examples of the layered thermite composite 10 may include an adhesion layer 17 above and below each carbide-containing ceramic layer 16. In the illustrated example, the adhesion layers 17 are made from titanium or chromium. Nickel may also be used as an adhesion layer in some examples. The illustrated examples of the adhesion layers 17 are about 5 nm to about 10 nm thick.

Figure 8:
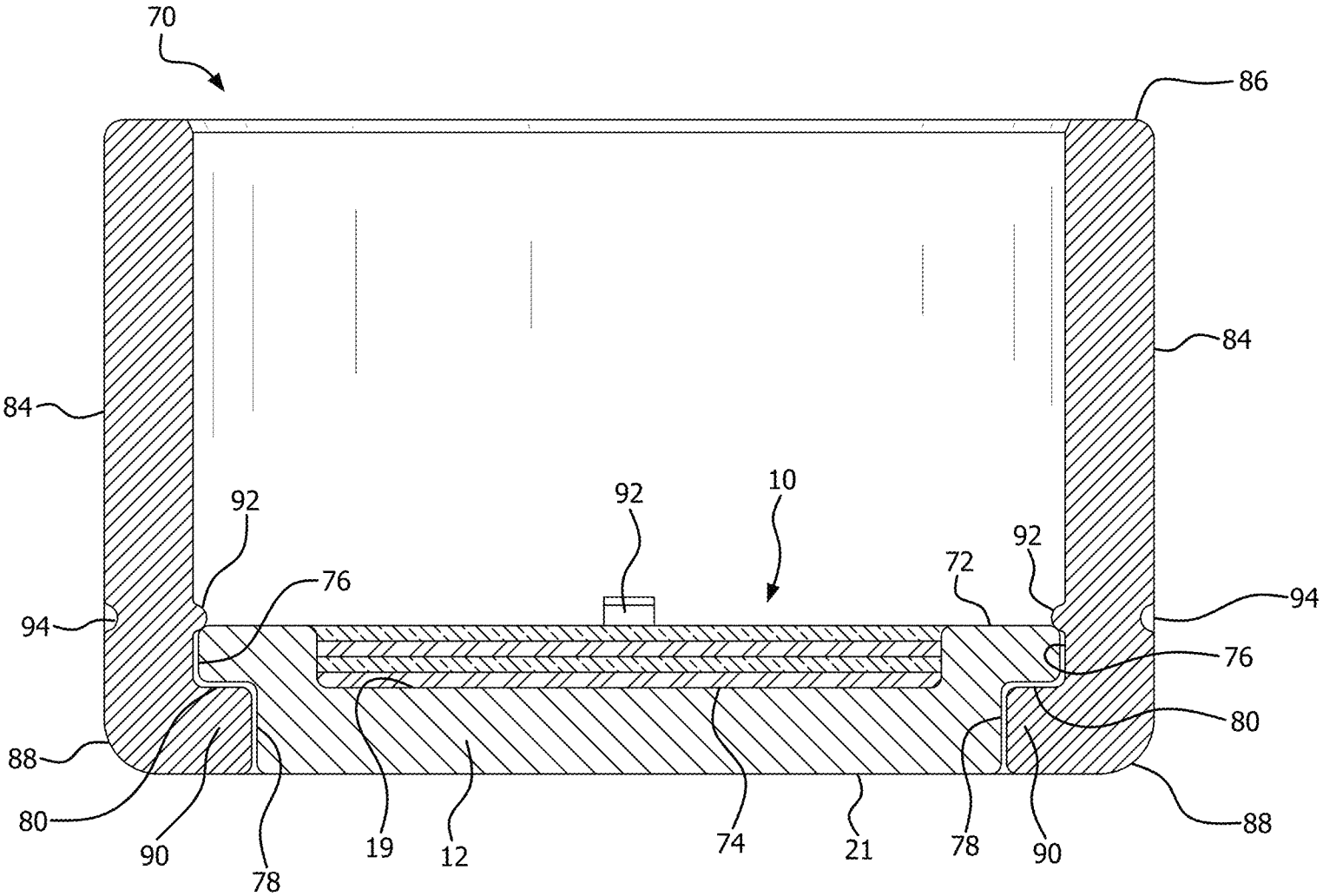
FIG. 8 is a side elevational, cross sectional view of a cup for use with a primer material of FIGS. 1-3.

FIG. 8 illustrates an example of a primer 70 utilizing the layered thermite composite 10. The illustrated example of the substrate 12 is a disk having an upper surface 72 defining a recess 74 in which the deposition surface 19 is located. The edge of the disk 12 includes a larger diameter portion 76 and a smaller diameter portion 78, forming a ledge 80 therebetween. The primer composite 10 is deposited on the surface 19 within the recess 74 as described above. The disk (substrate) 12 is then placed within a cup 82 to form a complete primer. The cup 82 includes a sidewall 84 having an upper end 86 and a lower end 88. The lower end 88 includes an inward projection 90 that is dimensioned and configured to abut the ledge 80 and a smaller diameter 78 of the disc 12. When the disc 12 is inserted into the cup 82 through the upper end 86, and then placed in position against the lower end 88, passage of the disc 12 out of the bottom end 88 of the cup 82 is thus resisted. The disc 12 may then be retained in the cup 82 by the inward projections 92 which engage the top surface 72 of the disc. The inward projections 92 may be formed by punching inward against the outer portion of the wall 84 to form depressions 94, thus creating a projection 92. Some examples may also, or alternatively retain the disc 12 within the cup 82 utilizing an adhesive.

Figure 9:
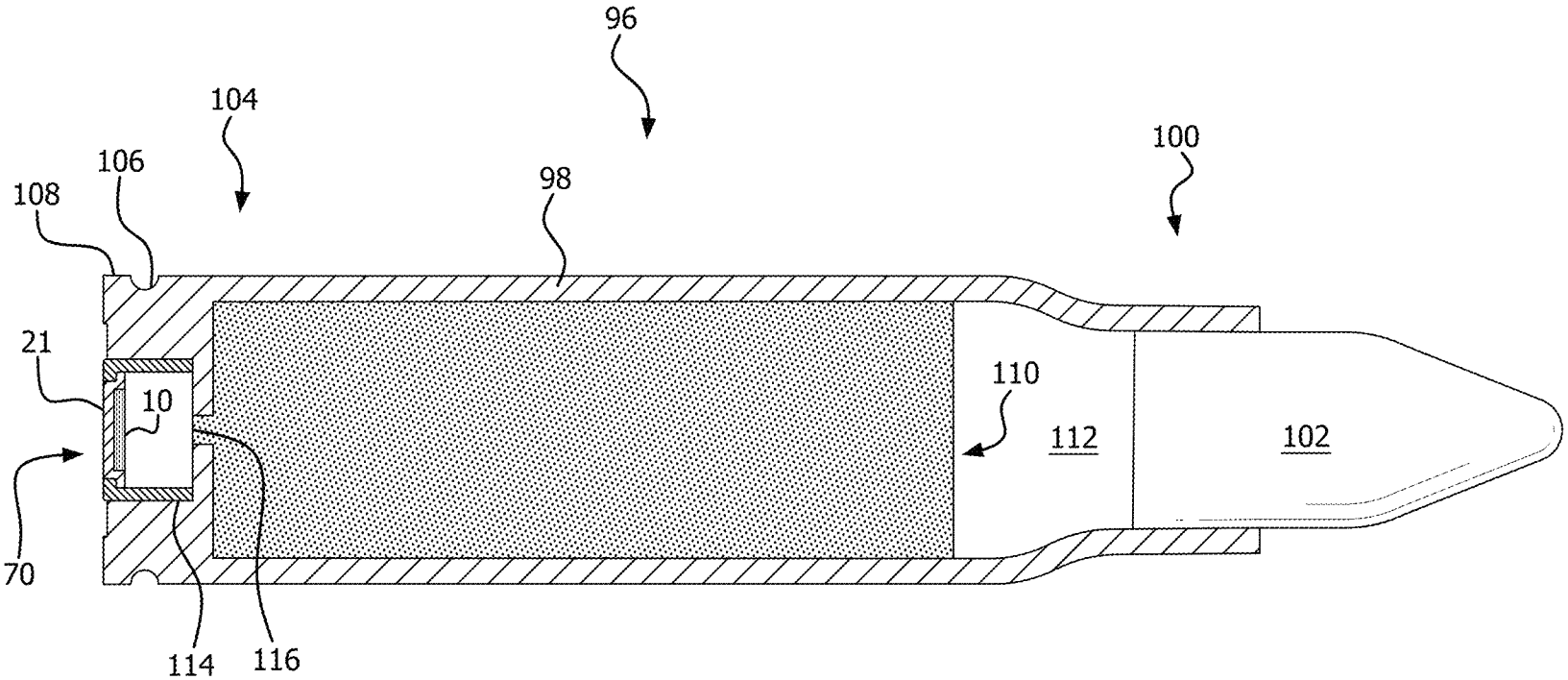
FIG. 9 is a side elevational, cross sectional view of a cartridge using a primer cup of FIG. 4.

Referring to FIG. 9, the primer 70 may then be placed within a conventional firearm cartridge 96. The cartridges 96 includes a casing 98 having a standard configuration. The casing 98 includes a front end 100 that is structured to retain a bullet 102 therein. The casing 98 also includes a back end 104 having a groove 106 and rim 108 to assist with extraction of the cartridge 96. A propellant 110 within the hollow central portion 112 of the casing 98. The back end 104 of the casing 98 defines a primer pocket 114 and a flash hole 116 extending between the primer pocket 114 and hollow central portion 112. Striking the surface 21 with a firing pin ignites the priming compound 10, driving reaction products through the flash hole 116 and into the propellant 110 discharge the bullet 102.

As another example, the layered thermite composite 10 can be used as the deposited ignitable material within the primer disclosed within US 2020/0400415, which was invented by Timothy Mohler and Daniel Yates and published on Dec. 24, 2020, the entire disclosure of which is expressly incorporated herein by reference.

Although the illustrated examples are for a firearm cartridge, a primer made with the layered thermite composite 10 can be used for a larger projectile cartridge such as those for artillery, or for other munitions such as hand grenades and other explosives that utilize a primer as part of their detonation mechanism.

The present invention therefore provides a primer made from materials that do not have the toxicity or other safety issues of conventional primers. The primers are easily and inexpensively manufactured by methods that lend themselves to automation. The multi-chamber deposition process eliminate the need to pump down deposition chambers when changing from one type of layer to another type of layer. The multi-chamber process minimizes the amount of time during which a completed reducing metal layer is exposed to oxygen, quickly transitioning from one deposition chamber to the next, resulting in the fuzzy interface layer. The primer provides at least the reliability of conventional primers while also taking advantage of the stability of thermite. The primer is useful not only for firearm cartridges, but also for other projectiles such as artillery, grenades, and other explosives and munitions. The primer is also useful for certain nail guns or other fastener guns which utilize primer-initiated propellants. One example of the primer will fit within a space designed for a conventional primer.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A layered thermite composite, comprising:

a substrate having a deposition surface and a rear surface;

alternating layers of metal oxide and reducing metal deposited upon the substrate, the alternating layers of metal oxide and reducing metal being structured to react with each other in response to an impact applied to the rear surface of the substrate; and a fuzzy interface layer disposed between each metal oxide layer and reducing metal layer, the fuzzy interface layer containing reducing metal, reducing metal oxide, and metal oxide, the reducing metal, reducing metal oxide, and metal oxide being at least partially mixed together.

2. The layered thermite composition according to claim 1, wherein each of the reducing metal and metal oxide are present within each fuzzy interface layer in a gradient structure, the gradient structure being a majority reducing metal and reducing metal oxide adjacent to each reducing metal layer, the gradient structure being a majority metal oxide adjacent to each metal oxide layer.

3. The layered thermite composition according to claim 1, wherein the reducing metal adjacent to and within the fuzzy interface layer resists oxidation and resists growth after completion of deposition and prior to ignition of the layered thermite composite.

4. A primer, comprising a substrate having a deposition surface and a rear surface;

alternating layers of metal oxide and reducing metal deposited upon the substrate, the alternating layers of metal oxide and reducing metal being structured to react with each other in response to an impact applied to the rear surface of the substrate; and a fuzzy interface layer disposed between each metal oxide layer and reducing metal layer, the fuzzy interface layer containing reducing metal, reducing metal oxide, and metal oxide, the reducing metal, reducing metal oxide, and metal oxide being at least partially mixed together.

5. The primer according to claim 4, wherein each of the reducing metal and metal oxide are present within each fuzzy interface layer in a gradient structure, the gradient structure being a majority reducing metal and reducing metal oxide adjacent to each reducing metal layer, the gradient structure being a majority metal oxide adjacent to each metal oxide layer.

6. The primer according to claim 4, wherein the reducing metal adjacent to and within the fuzzy interface layer resists oxidation and resists growth after completion of deposition and prior to ignition of the layered thermite composite.

7. The primer according to claim 4, further comprising at least one carbide-containing ceramic layer within the alternating layers of metal oxide and reducing metal, whereby, when the alternating layers of metal oxide and reducing metal react with each other, the at least one carbide-containing ceramic layer is ignited by the reaction between the reducing metal and metal oxide.

8. The primer according to claim 7, further comprising an adhesion layer separating each of the at least one carbide-containing ceramic layers and the layers of metal oxide or reducing metal which are adjacent to each of the at least one carbide-containing ceramic layers.

9. A cartridge for a firearm, the cartridge comprising:

a casing having a front end, a back end, and a hollow interior;

a bullet secured within the front end of the casing;

a propellant disposed within the hollow interior;

a primer secured within the back end of the casing, the primer being in communication with the propellant, the primer comprising;

a substrate having a deposition surface and a rear surface;

alternating layers of metal oxide and reducing metal deposited upon the substrate, the alternating layers of metal oxide and reducing metal being structured to react with each other in response to an impact applied to the rear surface of the substrate; and a fuzzy interface layer disposed between each metal oxide layer and reducing metal layer, the fuzzy interface layer containing reducing metal, reducing metal oxide, and metal oxide, the reducing metal, reducing metal oxide, and metal oxide being at least partially mixed together.

10. The cartridge according to claim 9, wherein each of the reducing metal and metal oxide are present within each fuzzy interface layer in a gradient structure, the gradient structure being a majority reducing metal and reducing metal oxide adjacent to each reducing metal layer, the gradient structure being a majority metal oxide adjacent to each metal oxide layer.

11. The cartridge according to claim 9, wherein the reducing metal adjacent to and within the fuzzy interface layer resists oxidation and resists growth after completion of deposition and prior to ignition of the layered thermite composite.

12. The cartridge according to claim 9, further comprising at least one carbide-containing ceramic layer within the alternating layers of metal oxide and reducing metal, whereby, when the alternating layers of metal oxide and reducing metal react with each other, the at least one carbide-containing ceramic layer is ignited by the reaction between the reducing metal and metal oxide.

13. The cartridge according to claim 12, further comprising an adhesion layer separating each of the at least one carbide-containing ceramic layers and the layers of metal oxide or reducing metal which are adjacent to each of the at least one carbide-containing ceramic layers.

* * * * *